US006869168B2

(12) United States Patent
Terui

(10) Patent No.: US 6,869,168 B2
(45) Date of Patent: Mar. 22, 2005

(54) LIQUID EJECTION PRINT HEAD

(75) Inventor: Makoto Terui, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 65 days.

(21) Appl. No.: 10/023,932

(22) Filed: Dec. 21, 2001

(65) Prior Publication Data

US 2002/0097299 A1 Jul. 25, 2002

(30) Foreign Application Priority Data

Dec. 21, 2000 (JP) ..... 2000-389249

(51) Int. Cl.[7] ..... B41J 2/16; B41J 2/14

(52) U.S. Cl. ..... 347/50; 347/58; 347/63; 347/49

(58) Field of Search ..... 347/49, 50, 58, 347/63, 20; B41J 2/14, 2/16, 2/15

(56) References Cited

U.S. PATENT DOCUMENTS 4,725,859 A * 2/1988 Shibata et al. ..... 347/58
4,740,800 A * 4/1988 Kyoshima ..... 347/67
5,580,468 A * 12/1996 Fujikawa et al. ..... 216/27
5,696,544 A * 12/1997 Komuro ..... 347/50
5,745,136 A * 4/1998 Saito ..... 347/50
5,798,780 A * 8/1998 Koizumi et al. ..... 347/50
6,024,439 A * 2/2000 Sueoka et al. ..... 347/50
6,084,612 A * 7/2000 Suzuki et al. ..... 347/50
6,099,109 A * 8/2000 Komuro ..... 347/50
6,126,271 A 10/2000 Terui ..... 347/50
2001/0052916 A1 * 12/2001 Komuro ..... 347/58

FOREIGN PATENT DOCUMENTS

JP 04235041 A * 8/1992 ..... B41J/2/045
JP 10264382 A * 10/1998 ..... B41J/2/045

* cited by examiner

*Primary Examiner*—Lamson Nguyen
*Assistant Examiner*—Leonard Liang
(74) *Attorney, Agent, or Firm*—Fitzpatrick, Cella, Harper & Scinto

(57) ABSTRACT

A liquid ejection print head includes a base accommodated in a frame and having electrothermal transducers supplied with energy from an external source for having liquid to eject the liquid to effect printing, a conductive layer for forming an electrical wiring, and a tape member for supporting the conductive layer. The tape member has connecting portions, which include (i) branch portions, which are electrically connected to the transducers via electrode portions on the base, and (ii) reinforcement portions, which are connected to dummy electrode portions on the base and are more rigid than the branch portions so as to prevent deformation of the branch portions.

19 Claims, 14 Drawing Sheets

LIQUID EJECTION PRINT HEAD

BACKGROUND OF THE INVENTION

This application is based on Patent Application No. 2000-389249 filed Dec. 21, 2000 in Japan, the content of which is incorporated hereinto by reference.

BACKGROUND OF THE INVENTION

1. Field of the Invention

The present invention relates to a liquid ejection print head which performs printing by ejecting a print liquid onto a printing surface of a print medium, and a tape provided with a base used for the same.

2. Description of the Related Art

A liquid ejection printing head, for example, an ink-jet printing head of a side shooter type, as shown in FIG. 11 and FIG. 12, includes a body having an ink supply portion 8 to which an ink tank (not shown) is mounted; a print element board 14 bonded to a bottom of a recessed portion 8*b* of the ink supply portion 8 to eject ink; and a frame member 3 having an opening 2*a* opposing the print element board 14 and electrically connected to each electrode of the print element board 14.

The bottom of the recessed portion 5*b* of the ink supply portion 8 is formed into flat shape by a metal core member 10 which is molded together with the body. At a periphery of the recessed portion 8*b* of the ink supply portion 8 the frame member 3 is securely attached.

At the bottom of the recessed portion 8*b* of the ink supply portion 8 one end of an ink supply passage 8*a* that introduces ink from the ink tank is opened. The cross-sectional shape of the ink supply passage 8*a* is shaped like a slot extending over a predetermined distance along arrays of ink ejection ports (described later).

The print element board 14 includes: a base 16 having an ink supply opening 14*a* communicating with an open end of the ink supply passage 8*a* in the ink supply portion 8 and a plurality of heaters arranged therein; and an orifice plate 12 having a plurality of ink supply branch passages 12*b*i for introducing ink from the ink supply opening 14*a* to each heater.

A plurality of heaters are arranged at both sides of the ink supply opening 14*a* so that they sandwich the ink supply opening 14*a*, at predetermined intervals in a line extending in a direction almost perpendicular to the plane of the paper in FIG. 12.

The base 16 has electrode portions 16*d* to which connecting portions 6*a*, 6*b* (described later) are connected at one end corresponding to each heater.

The orifice plate 12 has ink ejection ports 12*a*i formed at positions facing each heater in the base 16. The ink branch supply passages 12*b*i are provided individually for each heater in the base 16.

The print element board 14 and the frame member 3 are electrically connected to each other by tape automated bonding (TAB), for example. The frame member 3 includes a tape member 2 with an opening 2*a* and a conductive layer 6 bonded by an adhesive layer 4 to an entire surface of the tape member 2 on the side of the ink supply portion 8.

The tape member 2 is formed of resin, and the conductive layer 6 is formed of a metal sheet 20–30 $\mu$m in thickness. The periphery of the opening 2*a* encloses an area corresponding to the outer circumferential portion of the print element board 14 installed below. The conductive layer 6 has an opening 6A at a position corresponding to the opening 2*a* and also has a plurality of connecting portions 6*a*, 6*b* electrically connected to the corresponding electrode portions 16*d* of the base 16 of the print element board 14. One end of the narrow two or more connecting portions 6*a*, 6*b* extend from the periphery of the opening 6A of the conductive layer 6 to the corresponding electrode portions 16*d*, respectively.

A gap between the periphery of the opening 2*a* of the tape member 2 and the outer circumferential portion of the print element board 14 is sealed with a sealant 18. The sealant 18 covers the plurality of connecting portions 6*a*, 6*b* and encloses the print element board 14.

Arranging the print element board 14 to face the opening 2*a* of the tape member 2 of the frame member 3 and making electrical connections between them is performed as follows. First, the print element board 14 is located and positioned at a position relative to the opening 2*a* of the tape member 2 as by image processing or the like. Then, for example, one end of the connecting portions 6*a*, 6*b* are bonded to the electrode portions 16*d* of the base 16 of the print element board 14 as by thermocompression or ultrasonic vibration.

Then, the print element board 14 connected with the frame member 3 through the connecting portions 6*a*, 6*b* is positioned on and secured to the top surface of the ink supply portion 8. As a result, the print element board 14 is positioned relative to and reliably secured to the bottom of the recessed portion 8*b* of the ink supply portion 8.

When the connecting portions 6*a*, 6*b* are bonded to the electrode portions 16*d* of the base 16, lead forming is performed together with the bonding. Lead forming is defined as a process of correcting the amount of deformation of the connecting portions 6*a*, 6*b* to prevent the connecting portions 6*a*, 6*b* from contacting the edge of the base 16 (edge touch) as shown in FIG. 13A and thereby to prevent a short-circuit from occurring during operation.

When a gang bonder is used, the amount of lead forming is expressed based on a relative difference in height between the conductive layer 6 of the frame member 3 and the upper surface of the base 16, Lfa and Lfb, for example, as shown in FIG. 13B and FIG. 13C. Hence, the amount of lead forming for the height difference Lfa is larger than that for the height difference Lfb.

After having been subjected to a predetermined amount of lead forming, the frame member 3 and the print element board 14 coupled mutually through the connecting portions 6*a*, 6*b* are arranged at predetermined positions in the ink supply portion 8.

In the process of assembly, however, because the lead forming is performed while keeping the frame member 3 and the print element board 14 separated from the ink supply portion 8, and the print element board 14 is supported only by the elongate connecting portions 6*a*, 6*b* and the connecting portions 6*a*, 6*b* have insufficient rigidity and are easily deformed, the amount of lead forming may vary from one print head to another.

When there are variations in the amount of lead forming, the following problems occur.

First, since the variations in the amount of lead forming result in variations in the size of the gap between the periphery of the opening 2*a* of the tape member 2 and the outer circumferential portion of the print element board 14, the sealant 18 is not applied uniformly, resulting in defective sealing of the connecting portions 6*a*, 6*b*, which in turn may cause corrosion. To avoid such a situation, in some cases, the amount of sealant 18 applied could be increased. But this is not a good idea because it might clog the ejection openings with the sealant 18.

Second, problems arise when the frame member 3 is bonded to the ink supply portion 8.

Upon bonding the frame member 3 to the ink supply portion 8, with reference to the bonding surface of the frame member 3, the gap between the base 16 of the print element board 14 and the bottom of the recessed portion 8*b* can vary too, which may cause ink leakage or errors in the relative positions of the ejection openings of the orifice plate 12 with respect to the printing surface of the print medium.

Third, when the frame member 3 is bonded to the ink supply portion 8, upon bonding the frame member 3 to the ink supply portion 8, with reference to the bonding surface of the base 16, a gap is formed between the conductive layer 6 of the frame member 3 and the bonded surface of the ink supply portion 8, which may cause corrosion of the conductive layer 6 by ink.

SUMMARY OF THE INVENTION

Considering the problems described above, it is an object of the present invention to provide a liquid ejection print head which performs printing by ejecting a print liquid onto a surface of a print medium and which can minimize variations in the amount of lead forming.

To achieve the above objective, the present invention provides a tape provided with a base, comprising: a base having electrothermal transducers formed therein, the electrothermal transducers being adapted to heat a liquid used for printing and introduced through a liquid introduction passage and to eject the liquid through an ejection port forming surface; and a tape member arranged at a periphery of an accommodating portion where the base is accommodated, and having connecting portions including branch portions electrically connected to the electrothermal transducers in the base and reinforcement portions having a greater rigidity than that of the branch portions and connected at one end to dummy electrode portions on the base.

The present invention provides a liquid ejection print head, for example, an ink-jet printing head, which comprises: the tape provided with a base as above, a conductive layer having connecting portions joined to the tape member, the connecting portions being connected to electrode portions on the base, the electrode portions being electrically connected to the electrothermal transducers, and a body having a liquid supply portion for introducing the liquid to the base, wherein the connecting portions include branch portions branched at one end and electrically connected to electrode portions on the base and reinforcement portions having a greater rigidity than that of the branch portions and connected at one end to dummy electrode portions on the base.

In the above-described tape provided with a base and liquid ejection print head, the branch portions are power-supplying connecting portions and the electrode portions on the base to which they are connected are power-supplying electrode portions. The reinforcing portions are dummy electrode connecting portions and the electrode portions on the base to which they are connected are dummy electrode portions.

As can be seen from the explanation above, because the liquid ejection print head of this invention is characterized in that the connecting portions include branch portions branched at one end and electrically connected to electrode portions on the base and reinforcement portions having a greater rigidity than that of the branch portions and connected at one end to dummy electrode portions on the base, the base is supported by the branch portions and the reinforcement portions. This can prevent the branch portions from being deformed undesirably easily and minimize variations in the amount of lead forming.

Therefore, the base and the liquid supply portion are bonded together without a gap so that when the liquid is supplied to the base, there is no leakage of the liquid, thus ensuring a satisfactory printed image on a surface of the print medium.

The above and other objects, effects, features and advantages of the present invention will become more apparent from the following description of embodiments thereof taken in conjunction with the accompanying drawings.

DETAILED DESCRIPTION OF PREFERRED EMBODIMENTS

Figure 4:
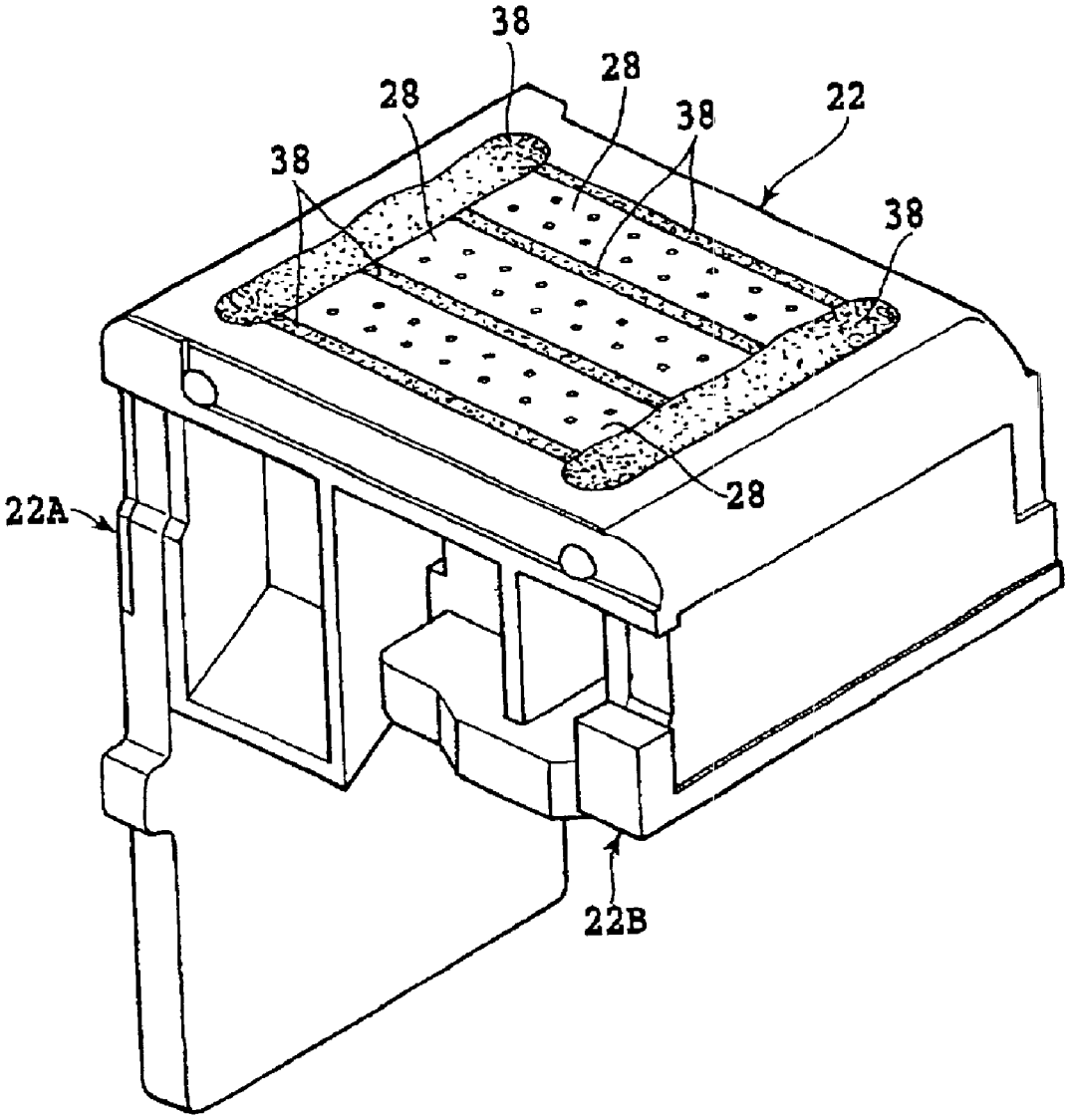
FIG. 4 is a perspective view showing an embodiment of the ink-jet printing head according to the present invention.
Figure 5:
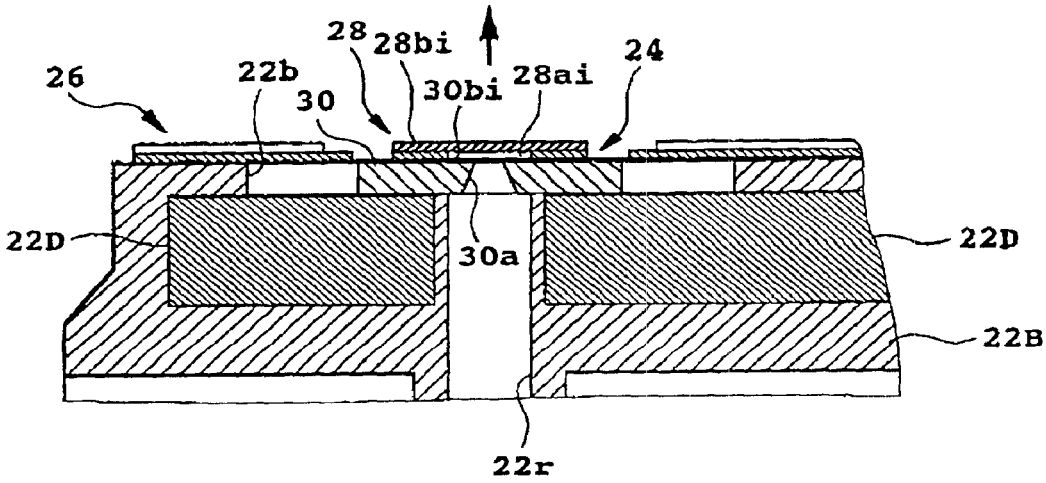
FIG. 5 is a partial cross-sectional view of an embodiment as shown in FIG. 4.

FIG. 4 and FIG. 5 show an external view of the liquid ejection print head according to the present invention and a part of the interior thereof, respectively.

The print head shown in FIG. 4 and FIG. 5 is an ink-jet printing head, for example.

The ink-jet printing head shown in FIG. 4 and FIG. 5 is, for example, a side shooter type which includes: a body 22 having an ink supply portion 22B to which ink tanks (not shown) are mounted and an input terminal unit 22A electrically connected to a carriage (not shown) to receive drive control signals from the carriage; three print element boards 24 bonded to a bonding surface of the ink supply portion 2213 of the body 22; and a frame member 26 electrically connected to the three print element boards 24 to supply the drive control signals from the input terminal unit 22A to each print element board 24.

The ink supply portion 22B has a recessed portion 22*b* in which three print element boards 24 are accommodated. A plurality of ink supply passages 22*r* for introducing inks from the ink tanks have one of their ends opened at the bottom of the recessed portion 22*b*, that forms the bonding surface, at positions corresponding to the print element boards 24. Arranged around the ink supply passages 22*r* is a core member 22D that is formed together with the ink supply portion 22B. The core member 22D is formed flat from, for example, an aluminum alloy material and has a predetermined planarity at its bottom surface.

The periphery of the recessed portion 22*b* is surrounded by a flat surface to which a frame member 26 (described later) is bonded.

The print element boards 24 eject inks of different colors, such as yellow, magenta and cyan, respectively.

Each of the print element boards 24 includes a base 30 and an orifice plate 28. The base 30 has an ink supply opening 30*a* communicating with an open end of the associated ink supply passage 22*r* in the ink supply portion 22B and heaters 30*b*i (i=1 to n, n is an integer) arranged on both sides of the ink supply opening 30*a*. The orifice plate 28 has a plurality of ink supply branch passages 28*a*i (i=1 to n, n is an integer) that supply ink from the ink supply opening 30*a* to the heaters 30*b*i.

The base 30 is formed from, for example, a silicon material into a plate with a predetermined thickness. The surface of the base 30 facing the bottom of the recessed portion 22*b* is bonded to that bottom. The heaters 30*b*i in the base 30 are formed from, for example, hafnium boride or tantalum nitride. The heaters 30*b*i in FIG. 5 are installed at pairs of intersections formed by two parallel longitudinal lines extending perpendicular to the plane of the paper on both sides of the ink supply opening 30*a* and a number of parallel oblique lines crossing the two longitudinal lines at predetermined intervals (600 dpi) at a predetermined angle. The heaters 30*b*i at each pair of intersections are arranged to face each other. On the outer circumferential portion of the base 30 including the heaters 30*b*i, a thin film of, for example, silicon dioxide ($SiO_2$) is deposited to a predetermined thickness as a protective film against ink. The thin film of silicon dioxide may be formed by sputtering. The heaters 30*b*i may be tantalum-aluminum (TaAl) anodic-oxidized heaters. In that case, a protective film against ink is not required.

Figure 3:
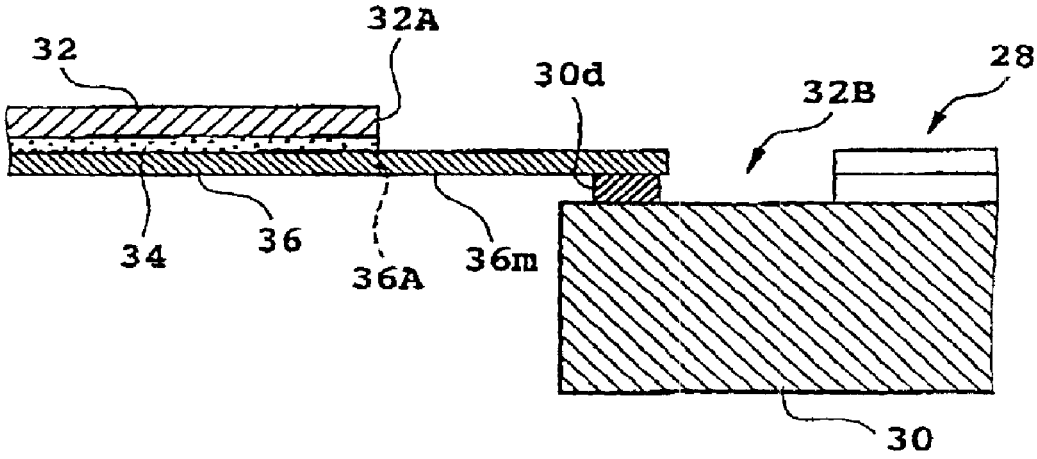
FIG. 3 is a partial cross-sectional view taken along the line III—III of FIG. 1A.

As shown in FIG. 3, the heaters 30*b*i are each electrically connected to electrode bumps 30*d* through a conductive layer (not shown). At each end of the base 30 on its short side the electrode bumps 30*d* are arrayed in a line at predetermined intervals in such a way that they correspond, one to one, to the associated heaters 30*b*i. The electrode bumps 30*d* may be formed about 18 μm high on the upper surface of the base 30.

The orifice plate 28 is formed from a thermosetting resin material into a plate with a predetermined thickness. The thermosetting resin material may be composed of 100 parts of a first component (trademark EHPE-3150: Daicel Chemical Industry make), 100 parts of a second component (trademark ADECAOPTOMER SP 170: Asahi Denka Gokyo make) and 1.5 parts of a third component (xylene), by weight.

Figure 1A:
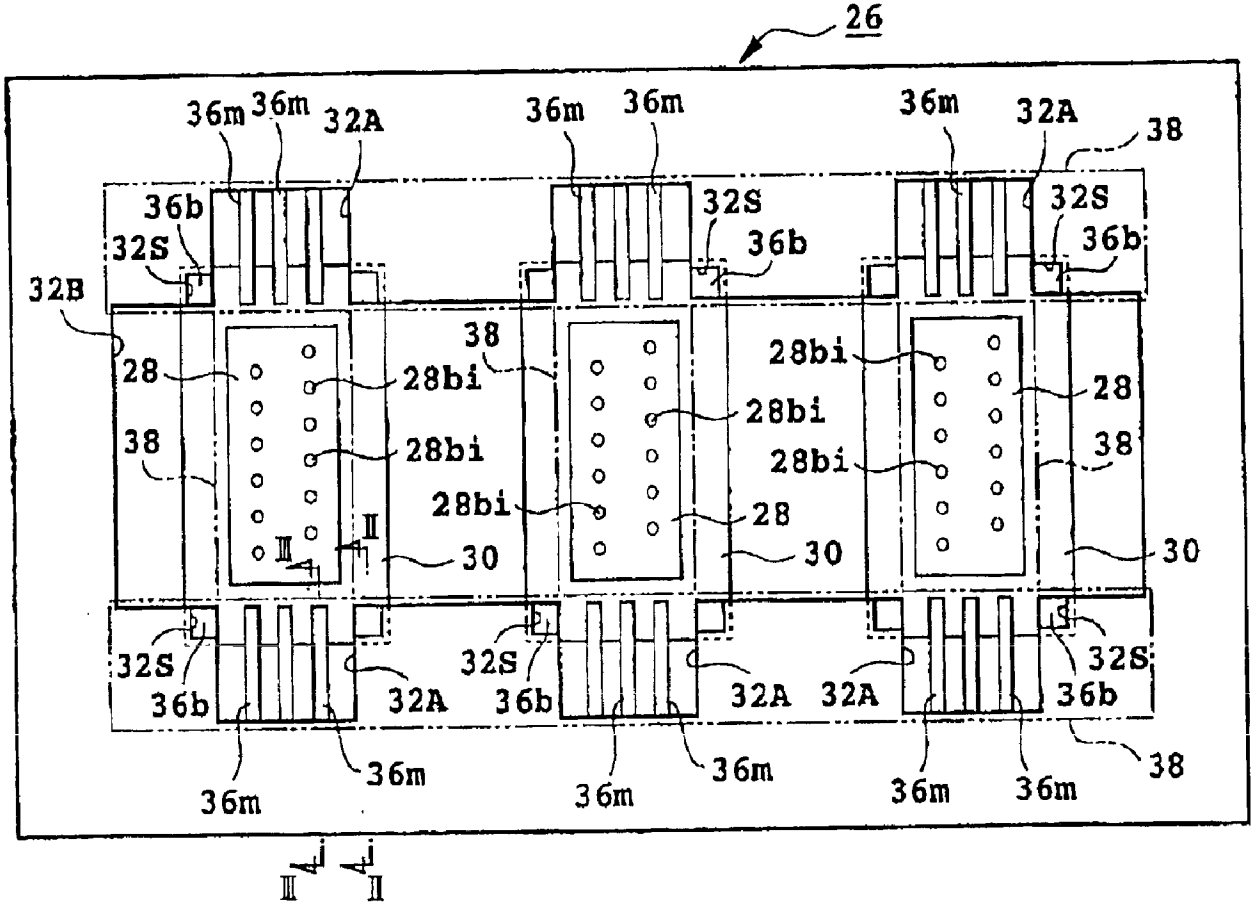
FIG. 1A is a plan view showing a frame member along with print element boards, used in an embodiment of the ink-jet printing head according to the present invention.

The orifice plate 28 has ink ejection ports 28*b*i at positions corresponding to the heaters 30*b*i of the base 30, as shown in FIG. 1A. The number of ink ejection ports may be set, for example, at 128, which is equal to that of the heaters 30*b*i. For illustrative convenience, FIG. 1A shows an enlarged view of a smaller number of ink ejection ports. The ink supply branch passages 28*a*i are separately provided for individual heaters 30*b*i of the base 30.

The frame member 26 is electrically connected to the electrode bumps 30*d* of the print element board 24 by the TAB system.

The frame member 26 comprises, as shown in FIG. 1A and FIG. 3, a tape member layer 32 forming an external surface layer and a conductive layer 36 bonded to the inner surface of the tape member layer 32 to be stacked on top of each other through an adhesive layer 34.

The tape member layer 32 is formed of, for example, polyimide resin, has a thickness of 50–125 μm, and surrounds the periphery of the recessed portion 22*b*.

The tape member layer 32 has opposed openings 32A, used as so-called device holes, in its inner area at opposing ends of the print element board 24 on its short sides. The tape member layer 32 also has an opening 32B that connects the opposing openings 32A to each other.

The openings 32A are formed in an almost rectangular shape at predetermined intervals to face branches 36*m* of the conductive layer 36 (described later). Base end-sides of the branches 36*m* in each opening 32A are spaced a predetermined distance from the ends of each print element board 24.

The opening 32B is formed in a rectangular shape extending in a direction of array of the openings 32A. Both ends of the periphery of the opening 32B are spaced a predetermined distance from the ends of the base 30 of the print element boards 24 installed below, respectively.

At corners where the openings 32A and the opening 32B in the tape member layer 32 intersect each other, almost square notches 32S are formed. This causes reinforcing portions 36*b* of the conductive layer 36 (described later) to be exposed through the notches 32S.

The conductive layer 36 is formed, for example, of a copper alloy material and has a thickness of about 23 μm. The conductive layer 36 has a plurality of openings 36A in its inner area at positions corresponding to the openings 32A of the tape member layer 32. In the openings 36A, the narrow branches 36*m*, as leads, are integrally formed with another portion, corresponding to electrode bumps 30*d*. The branches 36*m* are respectively bonded at one end to the electrode bumps 30*d* of the base 30 as by thermo-compression or ultrasonic-vibration or the like, as shown in FIG. 3. The branches 36*m* are power-supplying connecting portions, and the electrode bumps 30*d*, to which they are bonded, are power supplying electrode bumps.

The conductive layer 36 has an opening 36B at a position corresponding to the opening 32B of the tape member layer 32.

Figure 1B:
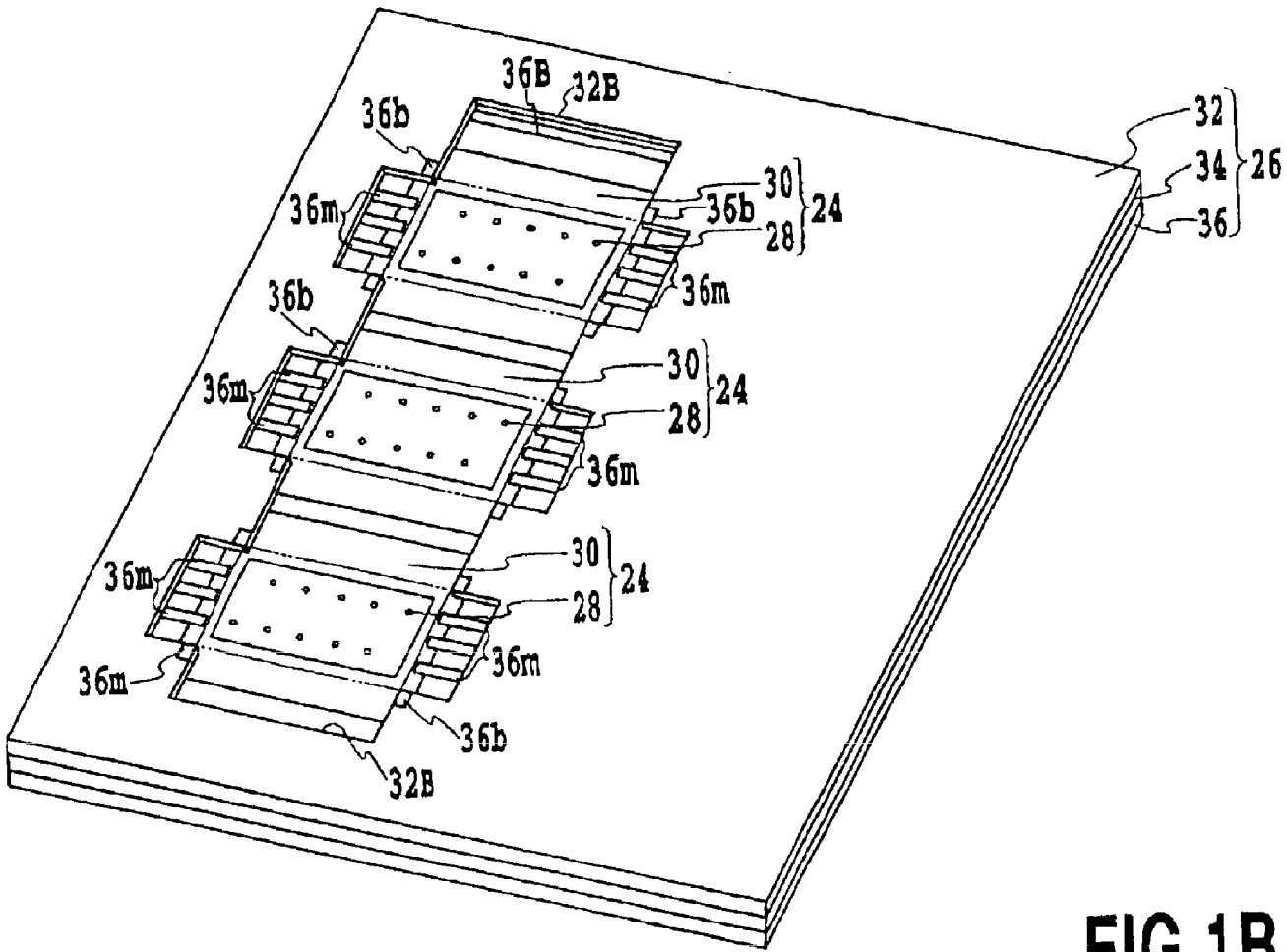
FIG. 1B is a perspective view showing the frame member being coupled to the print element boards.
Figure 2:
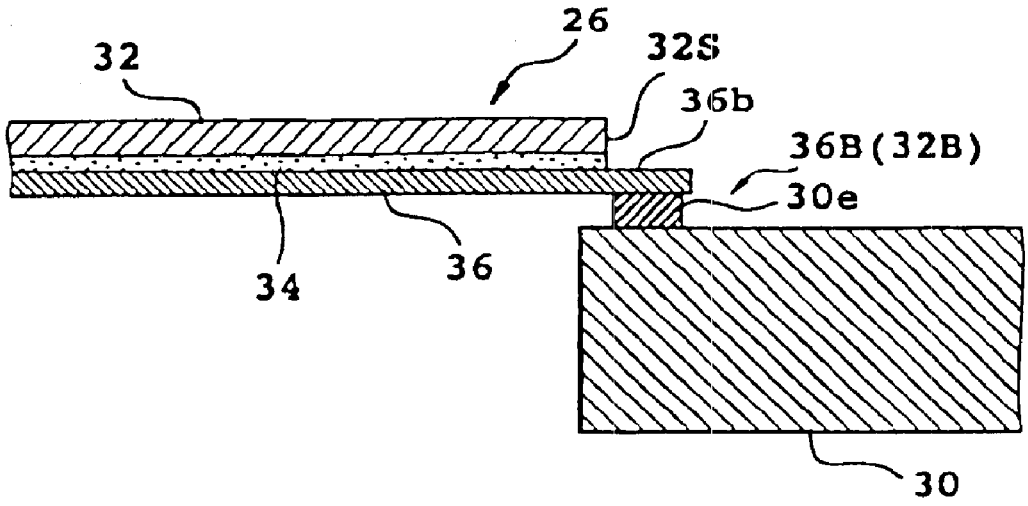
FIG. 2 is a partial cross-sectional view taken along the line II—II of FIG. 1A.

Further, as shown in FIG. 1B and FIG. 2, the conductive layer 36 has reinforcing portions 36*b* joined to the electrode bumps 30*e*, which are provided at the corners of the base 30. The reinforcing portions 36*b* bonded to the tape member layer 32 are formed between the laterally adjacent openings 36A for different print element boards 24 and on both sides of the opening 36B, respectively. The portions of the eight reinforcing portions 36*b* that face the electrode bumps 30*e* are joined to and supported by the electrode bumps 30*e*, respectively. The reinforcing portions 36*b* are not supplied with power when the ink-jet printing head is operated. Thus, the reinforcing portions 36*b* are dummy electrode connecting portions, and the electrode bumps 30*e*, to which they are connected, are dummy electrode bumps.

The gaps between the peripheries of the openings 32A, 32B of the tape member layer 32 and the outer circumferential portion of the orifice plate 28 and also the mutual gaps between the orifice plates 28 are sealed with a predetermined sealant 38 (FIG. 5).

Accordingly, when the reinforcing portions 36*b* of the conductive layer 36 are bonded to the electrode bumps 30*e* and the branches 36*m* of the conductive layer 36 are bonded to the electrode bumps 30*d*, and lead forming is performed with the frame member 26 and the print element boards 24 connected as shown in FIG. 1B, since the print element boards 24 are more firmly supported by the branches 36*m* and the reinforcing portions 36*b* of the conductive layer 36, which are bonded to the tape member layer 32, the rigidity of the supporting is enhanced, and the branches 36*m* do not easily become deformed.

This prevents the branches 36*m* from being deformed undesirably easily during the lead forming, thus minimizing variations in the amount of lead forming among the print element boards 24.

Then, the frame member 26 and the print element boards 24, both of which have been positioned relative to each other and subjected to lead forming, are bonded to their predetermined positions on the ink supply portion 22B of the body 22.

While in this example the reinforcing portions 36*b* are formed as a part of the conductive layer 36 bonded to the tape member layer 32, the present invention is not limited to this example. For example, it is possible to use as the reinforcing portions those portions of the tape member layer 32 bonded to the print element boards 24 that have a relatively high stiffness.

Figure 6:
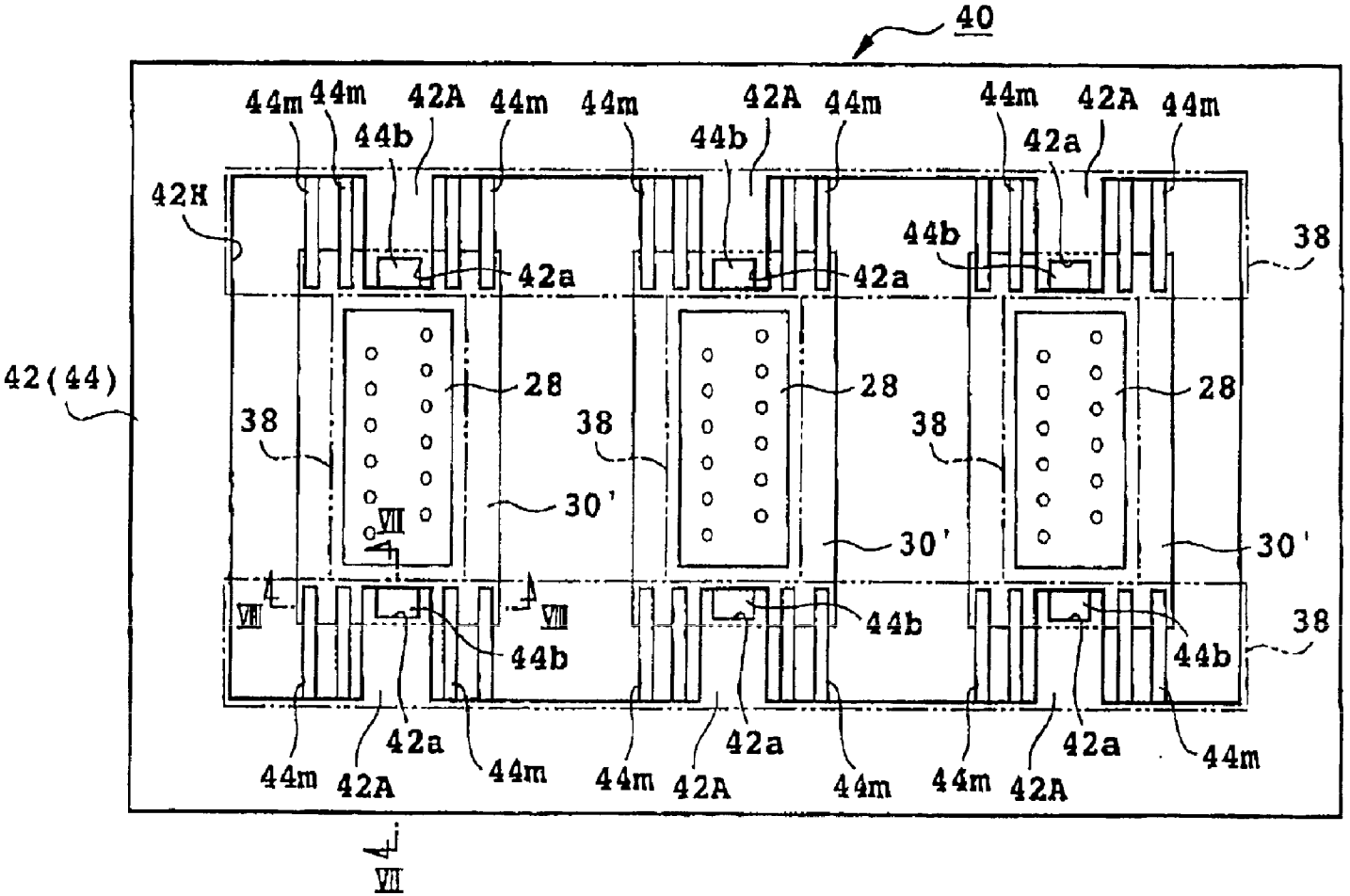
FIG. 6 is a plan view showing the frame member along with the print element boards, used in another embodiment of the ink-jet printing head according to the present invention.

FIG. 6 shows another example of the frame member in an example of the liquid ejection print head of the present invention.

In the example shown in FIG. 1A, the reinforcing portions 36*b* are provided between the laterally adjacent openings 32A and at the intersecting portions between the openings 32A and the opening 32B. In the example shown in FIG. 6, reinforcing portions 44A (FIG. 7) are provided between adjacent branches 44*m* for each base 30'.

In the example of FIG. 6 and in other examples described later, constitutional elements identical with those of FIG. 1A are given like reference numbers and their explanations are omitted.

Figure 8:
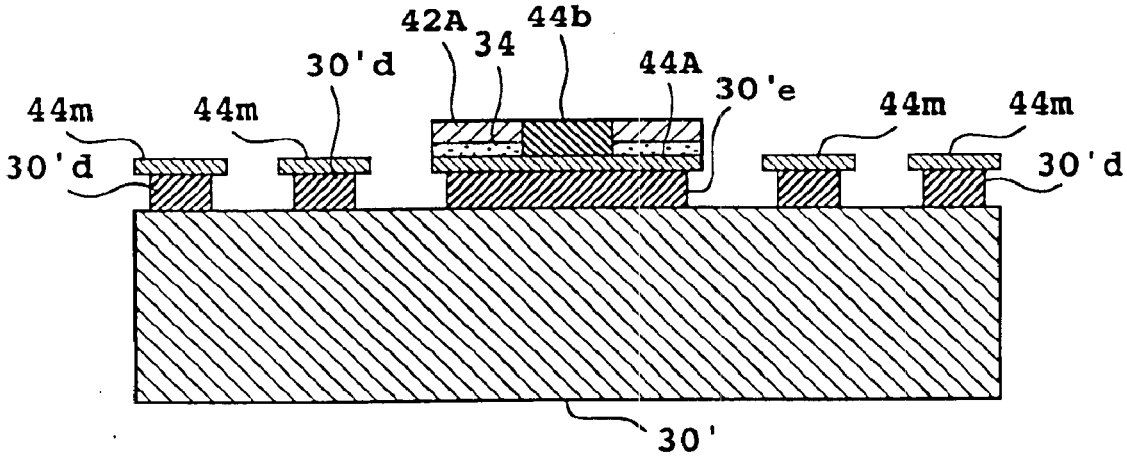
FIG. 8 is a partial cross-sectional view taken along the line VIII—VIII of FIG. 6.

As shown in FIG. 6 and FIG. 8, a frame member 40 is electrically connected to electrode bumps 30'*d* of the bases 30' by the TAB system.

Figure 7:
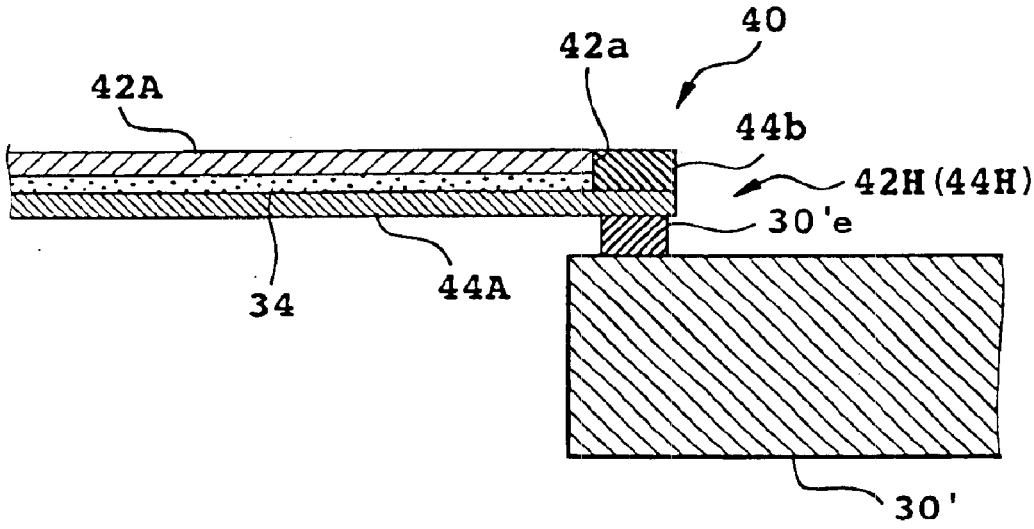
FIG. 7 is a partial cross-sectional view taken along the line VII—VII of FIG. 6.

As shown in FIG. 6 and FIG. 7, the frame member 40 comprises a tape member layer 42 forming an outer surface layer and a conductive layer 44 bonded to an inner surface of the tape member layer 42 to be stacked on top of each other through an adhesive layer 34.

The tape member layer 42 is formed of, for example, polyimide resin, has a thickness of 50–125 $\mu$m, and has an almost rectangular opening 42H, used as a so-called device hole, in its inner area.

The periphery of the opening 42H is spaced a predetermined distance from the outer circumferential portion of each print element board 24 installed at the bottom of the recessed portion 22*b* below.

Those portions of the periphery of the opening 42H which oppose the base 30' are integrally formed with projections 42A protruding inwardly on the same plane. At the front ends of projections 42A, notches 42*a* are formed, respectively. Thus, a part 44*b* of each reinforcing portion 44A of the conductive layer 44 (described later) is exposed through the notch 42*a*.

The conductive layer 44 is formed of, for example, a copper alloy material, has a thickness of about 23 $\mu$m, and has an opening 44H in its inner area at a position corresponding to the opening 42H of the tape member layer 42. In each opening 44H one end of an elongate branch 44*m*, as a lead, protrudes corresponding to an electrode bump 30'*d*. The branches 44*m* are bonded at one end to the electrode bumps 30'*d* of the base 30', respectively, as by thermocompression or ultrasonic-vibration or the like, as shown in FIG. 8. The base portions of the branches 44*m* are integrally formed with the conductive layer 44. The branches 44*m* are power-supplying connecting portions, and the electrode bumps 30'*d*, to which they are bonded, are power-supplying electrode bumps.

As shown in FIG. 7, the conductive layer 44 has reinforcing portions 44A bonded to electrode bumps 30'*e*, which are provided near centers of the both ends of the base 30'. The reinforcing portions 44A, provided between adjacent branches 44*m*, are bonded to the base 30' below the projections 42A, respectively. The portions 44*b* of the six reinforcing portions 44A, which face the electrode bumps 30'*e*, are bonded to the electrode bumps 30'*e*. These portions 44*b* of the reinforcing portions 44A, which face the electrode bumps 30'*e*, are not supplied with power when the ink-jet printing head is operated. Thus, reinforcing portions 44A, and portions 44*b* thereof, constitute dummy electrode connecting portions, and electrode bumps 30'*e*, to which they are bonded, constitute dummy electrode bumps.

The gap between the periphery of the opening 42H of the tape member layer 42 and the outer circumferential portions of the orifice plates 28 and the gap between the orifice plates 28 are sealed with a predetermined sealant 38.

Accordingly, when the reinforcing portions 44A of the conductive layer 44 are bonded to the dummy electrode bumps 30'*e*, the branches 44*m* of the conductive layer 44 are bonded to the power-supplying electrode bumps 30'*d*, and lead forming is performed, since the bases 30' are more firmly supported by the branches 44*m* and the reinforcing portions 44A, which are bonded to the projections 42A, the rigidity of the supporting is enhanced, and the branches 44*m* do not easily become deformed.

Thus the branches 44*m* are prevented from being deformed undesirably easily during the lead forming. As a result, an effect similar to that described above can be obtained.

Figure 9:
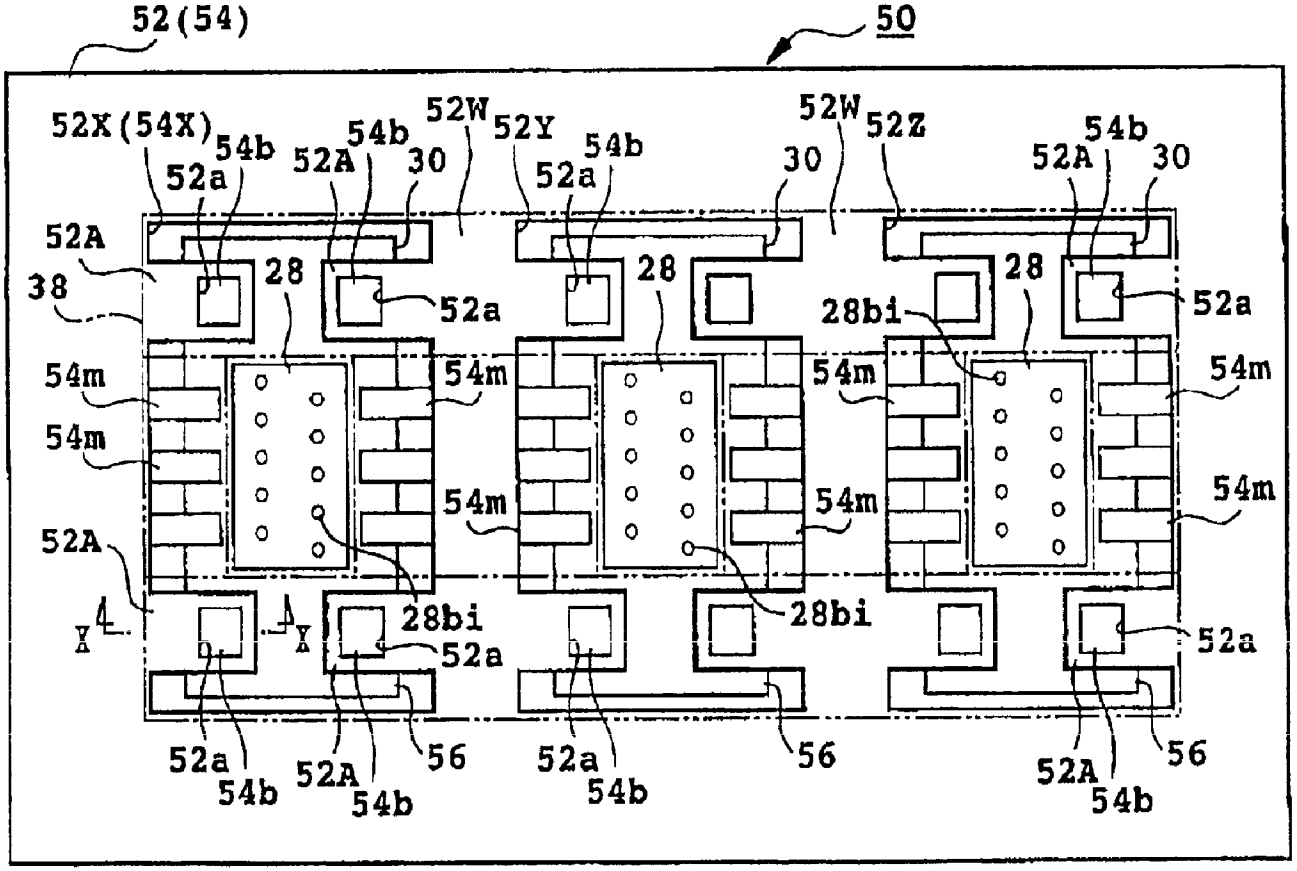
FIG. 9 is a plan view showing the frame member along with the print element boards, used in still another embodiment of the ink-jet printing head according to the present invention.
Figure 10:
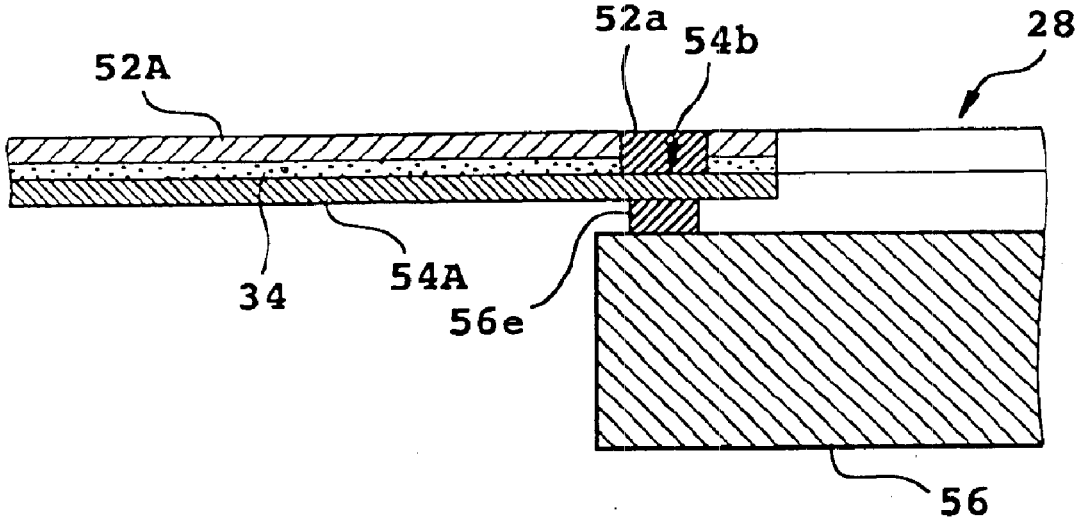
FIG. 10 is a partial cross section taken along the line X—X of FIG. 9.
Figure 11:
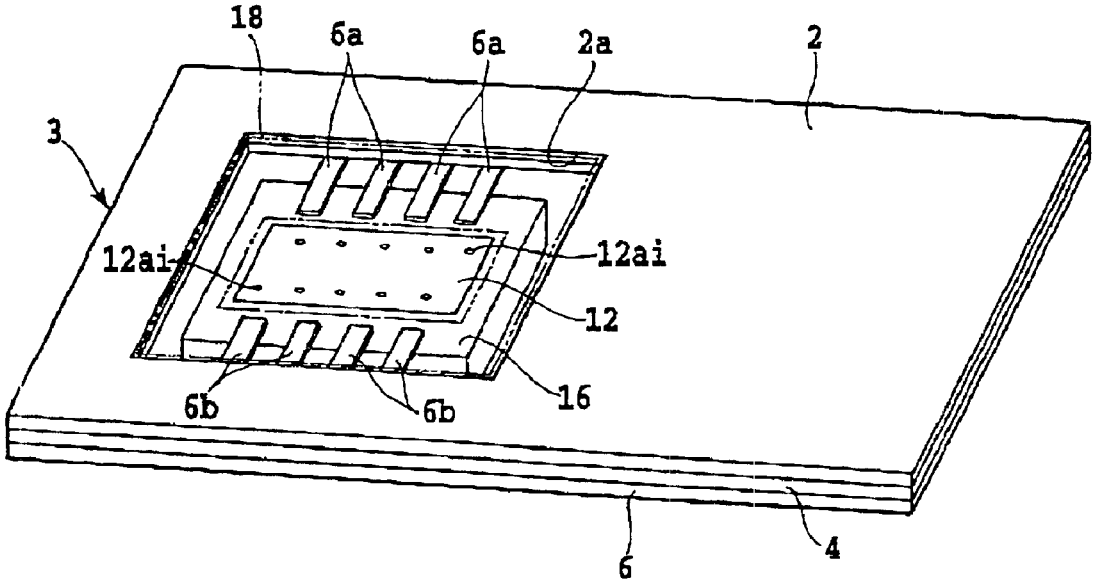
FIG. 11 is a perspective view showing a frame member used in a conventional ink-jet printing head.
Figure 12:
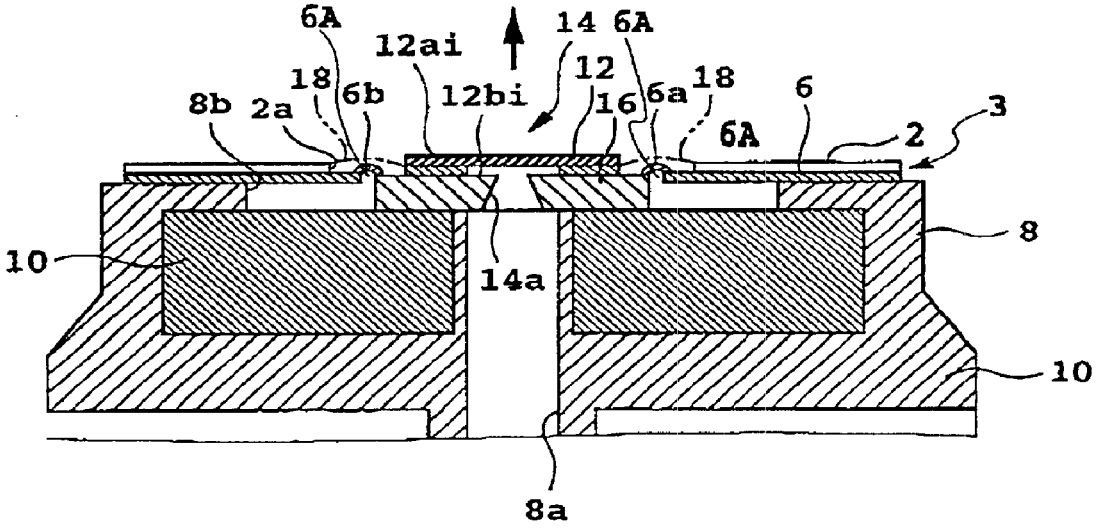
FIG. 12 is a partial cross section of an embodiment as shown in FIG. 11.
Figure 13A:
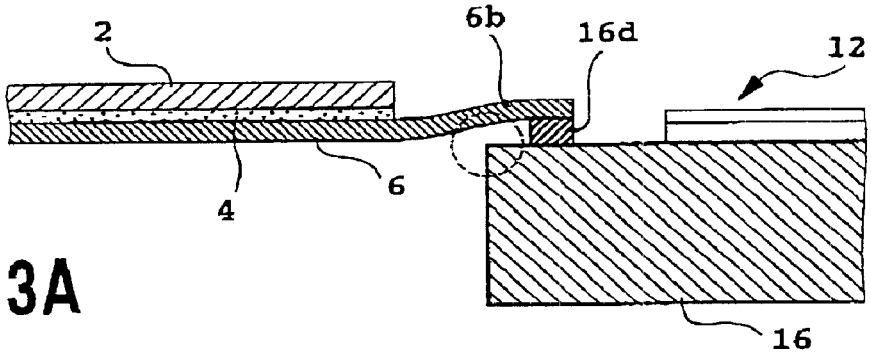
FIGS. 13A, 13B and 13C are partial cross sections used for explaining lead forming.
Figure 13B:
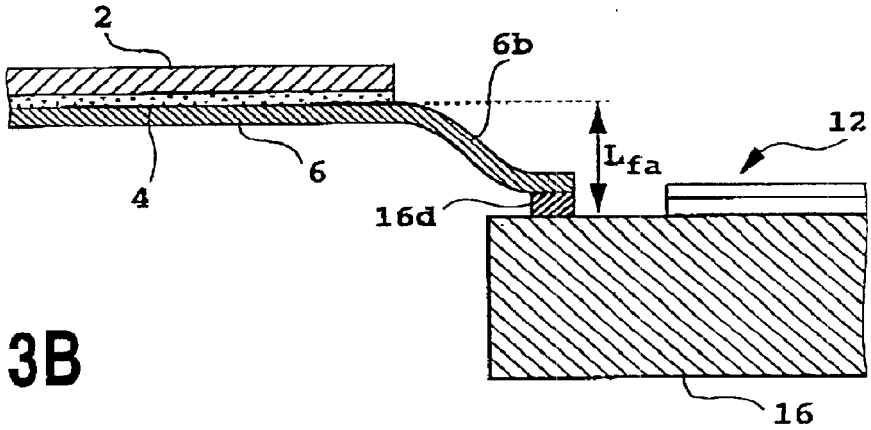
Figure 13C:
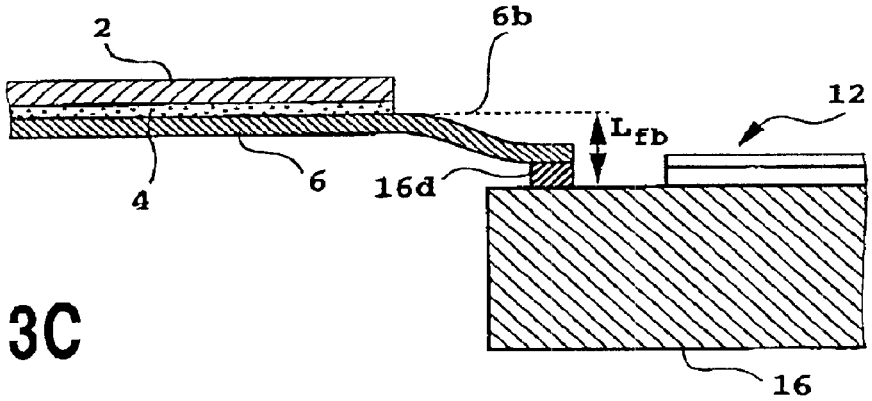

FIG. 9 and FIG. 10 show a still further example of the flame member in an embodiment of liquid ejection print head of the present invention.

In the example shown in FIG. 1A, a single opening 32B of the tape member layer 32 is formed to enclose the three orifice plates 28 arranged below. In the example shown in FIG. 9 and FIG. 10, a tape member layer 52 has three separate openings 52X, 52Y, 52Z formed therein, each facing a corresponding orifice plate 28.

The openings 52X, 52Y, and 52Z of the tape member 52 each have the same structure, and thus the structure of only the opening 52X and its periphery will be described. The explanation of the structure of the other openings 52Y and 52Z is omitted.

At each end of a base 56 on its long side, electrode bumps are arranged along the direction of an array of the ink ejection ports 28*b*i in the orifice plate 28.

A frame member 50 is electrically connected to the electrode bumps of the base 56 by the TAB system.

The frame member 50 comprises a tape member layer 52 forming an outer surface layer and a conductive layer 54 bonded to the inner surface of the tape member layer 52 to be stacked on top of each other through an adhesive layer 34.

The tape member layer 52 is formed of, for example, polyimide resin, has a thickness of 50–125 μm and has almost rectangular openings 52X, 52Y and 52Z, used as so-called device holes, in its inner area The periphery of the opening 52X is spaced a predetermined distance from the outer circumferential portion of the base 56 installed at the bottom of the recessed portion 22*b* below.

The periphery portion of the opening 52X opposing the base 56 has integrally formed therewith four opposing projections 52A that protrude inwardly toward the base 56 on the same plane as each other. At the front end of each of the projections 52A there is formed an almost square notch 52*a*, through which a part 54*b* of a reinforcing portion 54A of the conductive layer 54 (described later) is exposed.

The conductive layer 54 is formed of, for example, a copper alloy material, has a thickness of about 23 μm, and has in its inner area an opening 54X at a position corresponding to the opening 52X of the tape member layer 52. In the opening 54X, elongate branches 54*m*, as leads, whose base portions are integrally formed with the conductive layer 54, protrude corresponding to electrode bumps. The branches 54*m* are each bonded at one end to these electrode bumps, respectively, of the base 56 as by thermo-compression or ultrasonic-vibration. The branches 54*m* are power-supplying connecting portions, and the electrode bumps, to which they are bonded, are power-supplying electrode bumps.

The conductive layer 54 has four reinforcing portions 54A bonded at one end to dummy electrode bumps 56*e*, respectively, which are provided on the base 56 at respective ends of two groups of the power-supplying electrode bumps, to which the branches 54*m* are respectively bonded at one end. The reinforcing portions 54A extend under and are bonded to the associated projections 52A. The portions 54*b* of the four reinforcing portions 54A, which face the electrode bumps 56*e*, are bonded to them. These portions 54*b* of the reinforcing portions 54A, which face the electrode bumps 56*e*, are not supplied with electricity when the ink-jet printing head is operated. Thus the reinforcing portions 54A, and the portions 54*b* thereof, constitute dummy electrode connecting portions, and the electrode bumps 56*e*, to which they are bonded, constitute dummy electrode bumps.

The gap between the periphery of the opening 52X in the tape member layer 52 and the outer circumferential portion of the orifice plate 28 and the gap between the orifice plates 28 are sealed with a predetermined sealant 38.

Since the reinforcing portions 54A of the conductive layer 54 are bonded to the dummy electrode bumps 56*e* and the branches 54*m* of the conductive layer 54 are bonded to the power-supplying electrode bumps, the bases 56 are more firmly supported by the branches 54*m* and the reinforcing portions 54A, which are bonded to the projections 52A, than when supported only by the branches 54*m*. This prevents the branches 54*m* from being deformed undesirably easily during the lead forming. As a result, an effect similar to that described above can be obtained.

In the examples described above, although the ink-jet printing head has been described as ejecting inks of various colors, it may also eject a processing liquid that renders inks insoluble.

The present invention has been described in detail with respect to preferred embodiments, and it will now be apparent from the foregoing to those skilled in the art that changes and modifications may be made without departing from the invention in its broader aspects, and it is the intention, therefore, in the appended claims to cover all such changes and modifications as fall within the true spirit of the invention.

What is claimed is:

1. A tape provided with a base, comprising:

a tape-like frame member having an electrical wiring, said tape-like frame member including said base provided with elements for generating energy for ejecting a liquid to be used for printing through ejection ports, said base having a power-supplying electrode for receiving electrical power supplied to said elements from a source outside of said base, a conductive layer for forming said electrical wiring, and a tape member for supporting said conductive layer;

a dummy electrode provided at said base, said dummy electrode not receiving electricity from the source outside of said base;

a power-supplying connecting portion formed of a first portion of said conductive layer, said power-supplying connecting portion not being supported by said tape member, and said power-supplying connecting portion being conductively bonded to said power-supplying electrode; and a dummy electrode connecting portion formed of a second portion of said conductive layer, said dummy electrode connecting portion not being supported by said tape member, and said dummy electrode connecting portion being conductively bonded to said dummy electrode to which electricity is not supplied, wherein said dummy electrode connecting portion forms reinforcement portions for reinforcing a junction between said power-supplying connecting portion and said power-supplying electrode by bonding said dummy electrode connecting portion to said dummy electrode so as to hold said tape-like frame member to said base.

2. A tape provided with a base according to claim 1, wherein said reinforcement portions are arranged to face corners of said base.

3. A tape provided with a base according to claim 1, wherein said reinforcement portions are arranged to face almost central parts of opposing ends of said base.

4. A tape provided with a base according to claim 1, wherein said reinforcement portions are arranged to face opposing ends of said base and installed at a plurality of locations on each of said opposing ends.

5. A tape provided with a base according to claim 1, wherein parts of said tape member facing ends of said reinforcement portions, respectively, each have a notched portion.

6. A tape provided with a base according to claim 1, wherein, below an opening formed in a part of said tape member that faces an accommodating portion there are arranged a plurality of said bases to which said reinforcement portions are connected.

7. A tape provided with a base according to claim 6, wherein said opening is divided into a plurality of openings, one for each of said bases.

8. A tape provided with a base according to claim 1, wherein said base is arranged below an opening formed in a part of said tape member that faces an accommodating portion.

9. A liquid ejection print head for ejecting a liquid through ejection ports to effect printing, said liquid ejection print head comprising:

a supplying passage for supplying a liquid to said ejection ports;

a conductive layer for forming an electrical wiring;

a tape member for supporting said conductive layer;

a tape-like frame member including a base provided with elements for generating energy for ejecting a liquid to be used for printing through said ejection ports, said base having a power-supplying electrode for receiving electrical power supplied to said elements from a source outside of said base;

a dummy electrode provided at said base, said dummy electrode not receiving electricity from the source outside of said base;

a power-supplying connecting portion formed of a first portion of said conductive layer, said power-supplying connecting portion not being supported by said tape member, and said power-supplying connecting portion being conductively bonded to said power-supplying electrode; and a dummy electrode connecting portion formed of a second portion of said conductive layer, said dummy electrode connecting portion not being supported by said tape member, and said dummy electrode connecting portion being conductively bonded to said dummy electrode to which electricity is not supplied when said liquid ejection print head is operated, wherein said dummy electrode connecting portion forms reinforcement portions for reinforcing a junction between said power-supplying connecting portion and said power-supplying electrode by bonding said dummy electrode connecting portion to said dummy electrode so as to hold said tape-like frame member to said base.

10. A liquid ejection print head according to claim 9, wherein said reinforcement portions are arranged to face corners of said base.

11. A liquid ejection print head according to claim 9, wherein said reinforcement portions are arranged to face almost central parts of opposing ends of said base.

12. A liquid ejection print head according to claim 9, wherein said reinforcement portions are arranged to face opposing ends of said base and installed at a plurality of locations on each of said opposing ends.

13. A liquid ejection print head according to claim 9, wherein parts of said tape member facing ends of said reinforcement portions, respectively, each have a notched portion.

14. A liquid ejection print head according to claim 9, wherein, below an opening formed in a part of said tape member that faces an accommodating portion there are arranged a plurality of said bases to which said reinforcement portions are connected.

15. A liquid ejection print head according to claim 14, wherein said opening is divided into a plurality of openings, one for each of said bases.

16. A liquid ejection print head according to claim 9, wherein said base is arranged below an opening formed in a part of said tape member that faces an accommodating portion.

17. A liquid ejection print head according to claim 9, wherein branch portions and said reinforcement portions are arranged in a direction of an array of said ejection ports in an ejection port-forming surface.

18. A liquid ejection print head according to claim 9, wherein said power-supplying connecting portion and said dummy electrode connecting portion are arranged in a direction crossing a direction of an array of said ejection ports.

19. A liquid ejection print head according to claim 9, wherein the liquid is an ink or a processing liquid for rendering an ink insoluble.

* * * * *

UNITED STATES PATENT AND TRADEMARK OFFICE

CERTIFICATE OF CORRECTION

PATENT NO. : 6,869,168 B2
DATED : March 22, 2005
INVENTOR(S) : Makoto Terui

It is certified that error appears in the above-identified patent and that said Letters Patent is hereby corrected as shown below:

Title page,
Item [56], References Cited, FOREIGN PATENT DOCUMENTS, "04235041 A" should read -- 04-235041 A --; and "10264382 A" should read -- 10-264382 A --.
Item [57], ABSTRACT,
Line 3, "having" should read -- heating --.

Column 1,
Line 26, "portion 5*b*" should read -- portion 8*b* --.

Column 5,
Line 4, "2213" should read -- 22B --.

Column 8,
Line 54, "flame" should read -- frame --.

Column 9,
Line 13, "area" should read -- area. --.

Signed and Sealed this

Twenty-fourth Day of January, 2006

JON W. DUDAS
*Director of the United States Patent and Trademark Office*